US006139764A

United States Patent [19]

Hütte et al.

[11] Patent Number: 6,139,764

[45] Date of Patent: Oct. 31, 2000

[54] BIODEGRADABLE COATING COMPOSITIONS

[75] Inventors: Stephan Hütte, Köln; Hans-Joachim Wollweber, Krefeld, both of Germany

[73] Assignees: Bayer Aktiengesellschaft, Leverkusen; Bayer Faser GmbH, Dormagen, both of Germany

[21] Appl. No.: 09/245,494

[22] Filed: Feb. 5, 1999

[30] Foreign Application Priority Data

Feb. 9, 1998 [DE] Germany ..... 198 05 153

[51] Int. Cl.[7] ..... D06M 13/00; D06M 13/02

[52] U.S. Cl. ..... 252/8.81; 252/8.82; 252/8.83; 252/8.84; 252/8.85; 252/8.86; 106/267; 106/285

[58] Field of Search ..... 252/8.81, 8.82, 252/8.83, 8.84, 8.85, 8.86; 106/267, 285

[56] References Cited

U.S. PATENT DOCUMENTS

| | | | |
|---|---|---|---|
| 3,039,895 | 6/1962 | Yuk | 428/379 |
| 3,296,063 | 1/1967 | Chandler | 428/394 |
| 3,617,188 | 11/1971 | Snyder | 252/8.62 |
| 3,639,235 | 2/1972 | Karg | 252/8.81 |
| 3,652,419 | 3/1972 | Karg | 252/8.81 |
| 3,717,575 | 2/1973 | Rankin | 428/391 |
| 3,953,339 | 4/1976 | Obetz et al. | 252/8.81 |
| 3,954,635 | 5/1976 | Cummings, Jr. et al. | 252/8.82 |
| 4,082,679 | 4/1978 | Rhodes | 252/8.81 |
| 4,296,174 | 10/1981 | Hanzel et al. | 428/389 |
| 4,635,948 | 1/1987 | Zerfass et al. | 277/235 B |
| 5,135,575 | 8/1992 | Yang et al. | 106/287.16 |
| 5,378,249 | 1/1995 | Morrison | 44/388 |
| 5,389,269 | 2/1995 | Kleber et al. | 252/8.81 |
| 5,569,408 | 10/1996 | Peppmoller et al. | 508/462 |

FOREIGN PATENT DOCUMENTS

| | | | |
|---|---|---|---|
| 0493766 | 7/1992 | European Pat. Off. | D01F 9/22 |
| 0537687 | 4/1993 | European Pat. Off. | D06M 13/137 |
| 0643159 | 3/1995 | European Pat. Off. | D01F 6/70 |
| 1174739 | 7/1964 | Germany . | |
| 1279890 | 6/1969 | Germany | D06M 13/02 |
| 4243547 | 6/1994 | Germany | C07C 219/06 |
| 1101360 | 1/1968 | United Kingdom . | |
| 9208839 | 5/1992 | WIPO | D06P 5/00 |
| 9317172 | 9/1993 | WIPO | D06M 13/224 |
| 9415012 | 7/1994 | WIPO | D06M 15/61 |
| 9511948 | 5/1995 | WIPO | C09K 3/16 |
| 9749855 | 12/1997 | WIPO | D06M 13/224 |

OTHER PUBLICATIONS

Derwent Abstract of JP 10310979, Week 99068, May 1997.
Patent Abstract of Japan, vol. 097, No. 006, Jun. 30, 1997 Abstract of JP 09049167.
Database WPI, Week 862612, Oct. 1984 Abstract of JP 61097471.
C.R. Caryl et al. "Esters of Sodium Sulfosuccinic Acid" Industrial and Engineering Chemistry, published by the American Chemical Society (Jan. 1939) pp. 44–47 plus title page.
"Kunstsoffadditive" by R. Gächter and H. Mäller, Carl–Hanser–Verlag, Munich, vol. 3, (1990) pp. 779–8505 (No Month).
Derwent Abstract of JP 50069398 Reference NO. 85359W/52 (Oct. 26, 1973).
Derwent Abstract of JP 58203166 Reference No. 84–008541/02 (May 19, 1982).
Abstract of JP 83188875 (Oct. 8, 1983).
Neumüller, Otto–Albrecht: Römpps Chemie–Lexikon, Franckh'sche Verlagshandlung, Stuttgard, 1974 #1813,#1814,#2178 (No Month).
Abstract of JP 6067442 Sep. 22, 1983).
Abstract of 95006134 (May 31, 1988).
Derwent Abstract of JP 09049167 (Feb. 18, 1997).
Derwent Abstract of JP 09111657 (Apr. 28, 1997).

*Primary Examiner*—Anthony Green
*Attorney, Agent, or Firm*—Norris, McLaughlin & Marcus, P.A.

[57] ABSTRACT

This invention relates to biodegradable coating compositions based on readily biodegradable mineral oils. The invention furthermore relates to the use of the coating compositions for dressing plastic mouldings, fibers or yarns. In particular, the coating compositions exhibit advantages during further processing of elastic polyurethane fibers finished with the coating compositions or fabrics produced therefrom.

11 Claims, No Drawings

BIODEGRADABLE COATING COMPOSITIONS

This invention relates to biodegradable coating compositions based on readily biodegradable mineral oils. The invention furthermore relates to the use of the coating compositions for dressing plastic mouldings, fibres or yarns. In particular, the coating compositions exhibit advantages during further processing of elastic polyurethane fibres finished with the coating compositions or fabrics produced therefrom. For example, no environmentally questionable substances are released into the atmosphere or waste water during setting in a tenter frame or during washing of the fabric or fibres before dyeing.

For the purposes of the present invention, the term "fibre" includes staple fibres and/or continuous filaments which may be produced by per se known spinning processes, such as for example by dry spinning or wet spinning and by melt spinning.

Elastic polyurethane fibres made from long-chain synthetic polymers, synthesised from at least 85% segmented polyurethanes based, for example, on polyethers, polyesters and/or polycarbonates are conventional elastic fibres in the textiles industry. Yarns made from such fibres are used for the production of elastic fabrics, woven textiles or materials which are in turn suitable inter alia for corsetry, stockings and sports clothing, such as for example swimming costumes or swimming trunks.

In order to adapt the fibre surface to the conditions of further processing into textile products, the fibres are conventionally treated with surface treatment agents, so-called dressing oils. For example, elastane fibres are provided with a dressing in order to improve the processability of the fibres in yarn machinery.

During the production of fabrics or woven textiles or materials, for example during processing stages such as washing, heat setting or dyeing, various components such as oligomers or stabilisers are dissolved out of the polyurethane fibres and released into the environment or waste water. In typical processes for elastic textile goods, the dressing oils are also washed off the polyurethane fibres. The dressing oils used for dressing polyurethane fibres are conventionally dressings based on polydialkylsiloxane or mineral oil. These are described, for example, in the patents U.S. Pat. Nos. 3,296,063, 3,039,895, 5,135,575, 4,296,174, 3,039,895, 3,717,575, JP 188 875, JP 9 188 974 and JP 60-67442. According to the prior art, the dressing oils most frequently used at present are polydimethylsiloxanes or mixtures or dispersions containing polydimethylsiloxanes. The stated dressing oils have the considerable disadvantage that they are not biodegradable. They accumulate at various points in the environment if they are released into the natural environment. Under certain circumstances, it is thus necessary to separate the dressing oils removed during post-treatment of the textiles or fibres from the waste water before water treatment as the oils are not degraded, or only insufficiently so, in the biological purification stages of effluent treatment plants.

U.S. patent application Ser. No. 5,569,408 provides one solution to the problem of biodegradability of dressing oils for synthetic fibres, describing water-soluble and biodegradable softening agents based on carbonic acid polyesters. However, one disadvantage of the softening agents described in this patent document is the excessively high viscosity thereof. As a consequence, polyurethane fibres cannot successfully be coating using conventional dressing methods, for example by means of dressing rollers.

The object of the invention is to provide a readily biodegradable dressing for fibres, in particular for polyurethane fibres, which may readily be applied using known dressing methods. The intention is to ensure that, during production and processing of the polyurethane fibres to yield textiles, no dressing oils which are not biodegradable and may accumulate in the natural environment pass from the fibres into the atmosphere or waste water. The intention is furthermore to provide a dressing oil which, in comparison with the products used in the prior art, for example polydimethylsiloxane, exhibits no disadvantages during processing of the fibres, for example polyurethane fibres, due, for example, to fibre conglutination in textile machinery.

This object is achieved according to the invention by dressing the polyurethane fibres with an effective quantity of a readily biodegradable mineral oil. The dressing based on readily biodegradable mineral oils optionally contains further additives conventional in dressing oils for polyurethane fibres and is applied in a suitable form from the outside onto the elastic fibres.

The present invention provides a biodegradable coating composition for coating fibres, in particular elastane fibres, which composition contains biodegradable mineral oil having a viscosity of 2.5 to 100 mPa•s (20° C.), preferably of 2.5 to 50 mPa•s (20° C.) and a density of 790 to 880 kg/m$^3$ (15° C.), preferably of 805 to 860 kg/m$^3$ (15° C.) and having a viscosity/density constant (VDC) of 0.770 to 0.810, preferably having a VDC of 0.775 to 0.805 and particularly preferably having a VDC of 0.775 to 0.800.

The biodegradability of the mineral oil used in the coating composition may, for example, be determined using a test method to OECD 301 (Organisation for Economic Cooperation & Development). The viscosity/density constant (VDC) is determined to DIN 51 378.

As a consequence of dressing the polyurethane fibres with readily biodegradable mineral oils, no dressing oils which accumulate in the natural environment are released from the polyurethane fibres into the atmosphere or waste water during production and further processing of the polyurethane fibres, for example by washing, heat setting or dyeing.

The readily biodegradable mineral oils which may be used as dressing oils for polyurethane fibres may be provided with additives or a mixture of additives, as are conventional in the prior art. Such additives include, for example, lubricants, anti-static agents, anti-corrosion agents, defoamers, additives to avoid the formation of deposits during the production and processing of polyurethane fibres, etc..

A lubricant is a preferred additive to the readily biodegradable mineral oils, in particular a metal salt of saturated or unsaturated fatty acids. The content of lubricant is up to 15 wt. %, preferably up to 5 wt. %, particularly preferably up to 3 wt. %, relative to the entire coating composition. An Li, Na, K, Al, Mg, Ca or Zn salt of a higher fatty acid, in particular stearic acid, palmitic acid or oleic acid is preferred. Particularly preferred metal salts of fatty acids are Al stearate, Ca stearate, Li stearate, Mg stearate, Zn stearate, Mg palmitate or Mg oleate. Incorporation of the metal salts of fatty acids into the readily biodegradable mineral oils and the associated production of a finely divided dispersion may here proceed in the same manner as is described for dressing oils based on polydimethylsiloxane, by means of a grinding process, as is described for example in U.S. Pat. No. 5,135,575, or by means of a precipitation process, as is described for example in Japanese patent JP 60-67442.

A preferred coating composition additionally contains up to 15 wt. %, preferably from 0.05 to 5 wt. %, particularly preferably from 0.1 to 3 wt. %, of anti-static agent.

Cationic, anionic and/or nonionic compounds may be added to the readily biodegradable dressing as the anti-static agent. A review of possible anti-static agents is given in the book *Kunststoffadditive* by R. Gächter & H. Müller, Carl Hanser Verlag Munich, volume 3, 1990, pages 779 to 805. Examples of cationic anti-static agents are ammonium compounds in the form of quaternised fatty amines, ammonium salts of carboxylic acids, as are described, for example, in patent JP 09-111 657, or quaternised fatty acid triethanolamine ester salts, as are described, for example, in published patent application DE 4 243 547 A1. Anionic anti-static agents may, for example, be salts of sulfonic or phosphoric acids, as are described in patents EP 0 493 766, WO 95/11948, WO 94/15012 or JP 09 049 167. Anti-static agents in the form of nonionic compounds may, for example, be fatty or phosphoric acid esters or alkoxylated polydimethylsiloxanes, as are described in patents WO 93/17172, JP 95 006 134 or EP 0 643 159. The cationic and anionic compounds are more effective as anti-static agents than the nonionic compounds. Incorporation of the anti-static agent into the readily biodegradable mineral oils and the frequently associated production of a finely divided dispersion may proceed at any desired point in accordance with the above-stated method by means of a grinding process or a precipitation process.

Further preferred anti-static agents are dialkylsulfosuccinates of the general formula (1)

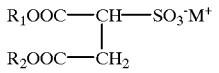

(1)

in which $R_1$ and $R_2$ mutually independently, identically or differently denote hydrogen or an alkyl group having 1 to 30 carbon atoms, preferably an alkyl group having 4 to 18 carbon atoms and $M^+$ is $H^+$, $Li^+$, $Na^+$, $K^+$ or $NH_4^+$.

Production of the dialkylsulfosuccinates may proceed as described in the literature reference C. R. Carly, *Ind. Eng. Chem.,* volume 31, page 45, 1939.

Especially preferred dialkylsulfosuccinates are sodium diisobutylsulfosuccinate, sodium dioctylsulfosuccinate, sodium dihexylsulfosuccinate, sodium diamylsulfosuccinate and sodium dicyclohexylsulfosuccinate.

Particularly preferred dialkylsulfosuccinates are sodium dioctylsulfosuccinate and sodium dihexylsulfosuccinate.

A very particularly preferred dialkylsulfosuccinate is sodium dioctylsulfosuccinate.

If the additives (for example lubricants, anti-static agents) are soluble in the readily biodegradable dressing oils, the additives may be added in the desired quantity and the dressing stirred until a homogeneous mixture is formed.

When selecting the additives to the readily biodegradable mineral oils, care must be taken to ensure that the additives have no action contrary to that of the readily biodegradable mineral oil. Thus, for example, the ready biodegradability and low viscosity of the dressing should be retained.

Due to the low viscosity of the readily biodegradable mineral oils, the dressings may be applied onto the polyurethane fibres using per se known dressing methods, for example by means of dressing rollers. Addition of the additives listed above by way of example may, however, mean that the finished dressing is in the form of a dispersion or emulsion. In this case, it is advantageous to use dispersions or emulsions which have particle sizes of on average <20 $\mu$m and are resistant to settling. In order to avoid settling and the associated deposition of solids in the dressing system during processing of the dressing, the dressing system may moreover be modified such that the dressing oil is kept in motion by continuous recirculation.

The present invention also provides the use of the coating composition according to the invention for the coating of mouldings made from polymers or of fibres, filaments or yarns, in particular of elastic fibres, filaments or yams, preferably of polyurethane fibres.

The polyurethane compositions or polyurethane fibres may contain a plurality of different additives for various purposes, such as flatting agents, fillers, anti-oxidants, dyes, colouring agents, stabilisers against heat, light, UV radiation and vapours. These additives are apportioned to the fibres in such a manner that they exhibit no action contrary to that of the coating composition based on readily biodegradable mineral oils applied from the outside.

The present invention also provides a process for dressing fibres, filaments or yarns, in particular polyurethane fibres, by applying the coating composition according to the invention onto the surface of the fibres, filaments or yarns.

The readily biodegradable coating compositions are applied, for example using a dressing roller, in a quantity of 0.5 to 15.0 wt. %, preferably in a quantity of 1.5 to 10.0 wt. % and particularly preferably in a quantity of 2.5 to 8.0 wt. %, relative to the weight of the fibres (filaments or yarns). If the readily biodegradable coating composition is applied onto the filament surface in a quantity of less than 0.5 wt. %, conglutination of, for example, the polyurethane fibres becomes too severe if the filaments are spun at an overall linear density of <80 dtex. As a consequence of to the conglutination and the resultant fibre breakages during further processing of the polyurethane fibres, production of textile fabrics is rendered more difficult, especially if the reels have been stored for an extended period or at elevated temperature. Application of more than 15.0 wt. % of the readily biodegradable dressing onto the polyurethane fibres results in severe soiling of the machinery during production and processing due to spattering and dripping of dressing oil and is thus also not advisable.

The polyurethane fibres which are preferably dressed with the coating composition according to the invention consist of segmented polyurethane polymers, such as for example those based on polyethers, polyesters, polyetheresters, polycarbonates. Such fibres may be produced using per se known processes, for example in accordance with those described in the documents U.S. Pat. Nos. 2,929,804, 3,097,192, 3,428,711; 3,553,290 and 3,555,115 and the document WO 9 309 174. The polyurethane fibres may furthermore consist of thermoplastic polyurethanes, the production of which is described, for example, in the document U.S. Pat. No. 5,565,270. All these polymers may be softened with the coating composition according to the invention in order to ensure good processability during the production of, for example, corsetry, underwear or sports articles.

It has been found that no technical disadvantages are encountered either during production of coating compositions (dressings) or in the production and processing of polyurethane fibres which are produced with a dressing according to the invention based on readily biodegradable mineral oils in comparison with polyurethane fibres with a dressing based on polydimethylsiloxanes. Example 1 shows a comparison of dressings based on readily biodegradable mineral oils and those based on polydimethylsiloxanes. It is also possible to obtain dressings based on readily biodegradable mineral oils and solid lubricants in the form of dispersions having a grain size distribution of on average <2 μm and good resistance to settling. Moreover, there is no conglutination of polyurethane fibres with a dressing based on readily biodegradable mineral oils, even after storage at elevated temperature. Furthermore, when the resultant polyurethane fibres are processed into stockings on an automatic hosiery making machine, there is virtually no machine downtime due, for example, to fibre snapping in the machine. It has also in particular been found that, after addition of small quantities of metal dialkylsulfosuccinate, in particular sodium dioctylsulfosuccinate, to the dressing oil based on readily biodegradable mineral oils, there is no deposition of solids from the dispersion in the dressing system or on the dressing rollers, even after extending testing. As a result, less effort is expended on cleaning the dressing system and blockages of, for example, feed lines though which the dressing oil is passed from a storage tank to the dressing point, are prevented. It has moreover been found that, by adding small quantities of metal sulfosuccinate to the dressing oil based on a biodegradable mineral oil, it was possible greatly to reduce the electrical resistance of polyurethane fibres dressed therewith. Electrostatic charging of the polyurethane fibres during processing to textile fabrics, for example by warp knitting, may be avoided thanks to the elevated effectiveness of the anti-static action of the metal sulfosuccinates.

The advantage of the novel, readily biodegradable dressing oils for polyurethane fibres in comparison with the softening agents using according to the prior art is evident in the application of the dressing onto polyurethane fibres and in further processing to fabrics. As a result, due to the readily biodegradable mineral oils, no dressing oils which accumulate in the atmosphere or waste water are released.

The polyurethanes, also including segmented polyurethanes, are in principle in particular produced from a linear homo- or copolymer having a hydroxy group on each end of the molecule and a molecular weight of 600 to 4000 g/mole, such as for example polyether diols, polyester diols, polyesteramide diols, polycarbonate diols, polyacrylic diols, polythioester diols, polythioether diols, polyhydrocarboxylic diols or from a mixture or copolymers of this group. The polyurethane is furthermore in particular based on organic diisocyanates and a chain extender having two or more active hydrogen atoms, such as for example di- and polyols, di- and polyamines, hydroxylamines, hydrazines, polyhydrazines, polysemicarbazides, water or a mixture of these components.

The test methods described below are used to measure the parameters discussed above.

Grain size distributions, in the event that the dressings are in dispersion form, are determined by means of a Mastersizer M20, Malvern Instruments, by laser diffraction and laser scattering. Grain size is stated in micrometres (μm) at a percentage distribution by volume of 10, 50 and 90%.

The viscosity of the dressings is measured using a Haake, model CV 100 viscosimeter at a temperature of 20° C. and a shear rate of 300 $s^{-1}$.

In the event that the dressings are in dispersion form, settling behaviour is determined by placing 100 ml of dressing oil in a measuring cylinder and determining the proportion of the segregated phase in percent after three and ten days. Good stabilisation against settling is achieved if, even after 10 days, the clear phase constitutes <20%.

The change in electrical conductivity of the polyurethane fibres is determined by the volume resistance measurement described in DIN 54 345.

Deposition in the dressing system is determined only for those dressing oils which are in dispersion form. To this end, the dressing oil is applied onto the polyurethane fibre without interruption for 14 days in a long-term test. At the end of the test, the quantity of solids which has been deposited from the dispersion in the dressing system is assessed. The greater the quantity of solids deposited, the worse is the dressing, as the dressing system with its lines and dressing roller must be cleaned more frequently in order, for example, to prevent irregularities in the application of the dressing or interruptions in the production process of the polyurethane fibres.

Adhesion of the fibre on the reel is determined by suspending a weight on the fibre and determining the weight at which the fibre unwinds itself from the reel. The adhesion determined in this manner is a measure of the processability of the reels produced. If adhesion is too high, further processing into fabrics may be rendered more difficult by fibre snapping. Determination of adhesion after 8 weeks' storage at an elevated temperature of 40° C. describes an ageing process and is a measure of the change in adhesion after a longer period of storage at room temperature. The reels are stored at 40° C. in a heated cabinet at a relative atmospheric humidity of 60%. Adhesion is then measured as described above.

In the processing of the polyurethane fibres on an automatic hosiery making machine with polyamide as the second fibre (ratio 20:80), stockings are produced at a processing speed of 600 m/min for a period of 2 hours and the number of fibre breakages counted. Evaluation of processing on an automatic hosiery making machine is accordingly a measure of the quality of processability of polyurethane fibres which have been softened with different dressing oils.

The invention is illustrated below by means of Examples which do not, however, restrict the invention. All percentages below relate to the total weight of the polyurethane fibre.

EXAMPLES

In this Example, a polyurethane composition is produced from a polyether diol consisting of polytetrahydrofuran (PTHF) having an average molecular weight of 2000 g/mole. The diol is capped with methylene bis(4-phenyl diisocyanate) (MDI) at a molar ratio of 1:1.8 and then chain-extended with a mixture of ethylenediamine (EDA) and diethylamine (DEA) in dimethylacetamide as solvent. The solids content of the segmented polyurethane produced in this manner is 30 wt. %. The polyurethaneurea solution has a viscosity of 120 Pa•s (50° C.) and the polymer an intrinsic viscosity of 0.98 g/dl (measured at 25° C. in DMAc at a concentration of 0.5 g of polymer in 100 ml of DMAc).

Before the dry spinning process, the following additives are added to the polyurethaneurea solution: (a) 1.0% 1,3,5-tris(4-tert-butyl-3-hydroxy-2,5-dimethyl-benzyl)-3,5-triazine-2,4,6-(1 H,3 H,5 H)-trione (Cyanox 1790, Cytec), (b) 0.05% titanium dioxide, (c) 0.15% Mg stearate and (d) 0.15% polyalkyloxy-modified polydimethylsiloxane (Silwet L 7607, OSI Specialties).

The finished spinning solution is spun through spinnerets in a typical dry spinning apparatus to yield a monofilament of a linear density of 17 dtex. The polyurethane fibre is wound up at a speed of 900 m/min.

The composition of the fibre dressings used in the Examples is described in table 1 and the dressings characterised by measurement of the grain size distribution, viscosity and settling behaviour.

The dressings containing Mg stearate are produced by a precipitation process. To this end, Mg stearate, distearyl tetraethylene oxide phosphoric acid ester and/or sodium dioctylsulfosuccinate are dissolved in 10 wt. % mineral oil, relative to the weight of the dressing, at a temperature of 135° C. The hot solution is rapidly poured into the remainder of the dressing oil, which is being stirred at a temperature of 20° C.

The grain size distribution, viscosity measurement and settling behaviour results show that dressing oils based on readily biodegradable mineral oils may be produced in a comparable form to those based on polydimethylsiloxanes and give rise to stable dispersions. They all exhibit a very good grain size distribution, a low viscosity and very good settling behaviour.

TABLE 1

Characterisation of various dressing oils

| Dressing | Composition | Grain size distribution D10 | D50 | D90 | Viscosity [mPa · s](1) | Settling behaviour 3d % | 10d % |
|---|---|---|---|---|---|---|---|
| 1 | Mineral oil a) | — | — | — | 7 | — | — |
| 2 | 98% mineral oil a)<br>1% (2)<br>1% Mg stearate | 0.42 | 1.68 | 4.8 | 7.7 | 0 | 2 |
| 3 | 96.5% mineral oil a)<br>1% (2)<br>2% Mg stearate<br>0.5% Na succinate b) | 0.6 | 1.99 | 5.24 | 17.7 | 10 | 10 |
| 4 | 88% polydimethylsiloxane (3 mPa · s, 25° C.)<br>10% paraffin<br>2% (2)<br>1% Mg stearate | 0.61 | 2.57 | 5.89 | 8 | 0 | 8 |

a) readily biodegradable;
b) sodium dioctylsulfosuccinate, Cytec;
(1) 25° C.
(2) distearyl tetraethylene oxide phosphoric acid ester The dressing oils stated in table 1 are applied by means of a dressing roller in a quantity of 4.0 wt. %, relative to the weight of the polyurethane fibre. Table 2 shows the results relating to the formation of deposits in the dressing system, in lines and on dressing rollers after a long-term test of 14 days, to the increase in adhesion after a period of storage at elevated temperature and to processability on an automatic hosiery making machine.

It is evident that the addition of sodium dioctylsulfosuccinate to a dressing based on readily biodegradable mineral oils, which dressing is in dispersion form, greatly reduces the electrical resistance of the polyurethane fibres. This demonstrates the effectiveness of sodium dioctylsulfosuccinate as an anti-static agent.

The elevated electrical resistance of polyurethane fibres coated with dressings 2 and 4 in comparison with dressing 1 may be explained by the highly hydrophobic nature of the phosphoric acid ester used and the presence of a dressing in dispersion form.

It is furthermore evident that by the addition of sodium dioctylsulfosuccinate to a dressing based on readily biodegradable mineral oils which, as in dressing 3, is in dispersion form, no deposition of solids from the dressing is observable in the dressing system even after a test period of 14 days. The evaluation of the increase in adhesion and processing on the automatic hosiery making machines also reveal no difference between dressing oils based on readily biodegradable mineral oils and those based on polydimethylsiloxanes.

The stated experiments are an impressive confirmation of the suitability of dressings based on readily biodegradable mineral oils for dressing polyurethane fibres.

TABLE 2

Processing results of polyurethane fibres with different dressing oils

| Dressing | Composition | Volume resistance ($10^{11}$ Ohm) 100 V c) | 1000 V c) | Deposits in the dressing system | Adhesion cN after production | after 8 weeks at 40° C. | Processing, Elan unit Number of fibre breakages |
|---|---|---|---|---|---|---|---|
| 1 | Mineral oil a) | 1.5 | 1.4 | — | 0.18 | 0.33 | 0 |
| 2 | 98% mineral oil a)<br>1% (1)<br>1% Mg stearate | 1.8 | 2.0 | moderate | 0.08 | 0.1 | 0 |
| 3 | 96.5% mineral oil a)<br>1% (1)<br>2% Mg stearate<br>0.5% Na succinate c) | 0.4 | 0.4 | none | 0.05 | 0.05 | 0 |

TABLE 2-continued

Processing results of polyurethane fibres with different dressing oils

| Dressing | Composition | Volume resistance ($10^{11}$ Ohm) 100 V c) | 1000 V c) | Deposits in the dressing system | Adhesion cN after production | after 8 weeks at 40° C. | Processing, Elan unit Number of fibre breakages |
|---|---|---|---|---|---|---|---|
| 4 | 88% (2)<br>10% paraffin<br>1%(1)<br>1% Mg stearate | 1.1 | 1.2 | moderate | 0.06 | 0.1 | 0 |

a) readily biodegradable;
b) sodium dioctylsulfosuccinate, Cytec;
c) direct current measurement voltage
(1) distearyl tetraethylene oxide phosphoric acid ester
(2) polydimethylsiloxane (3 mPa · s, 25° C.)

What is claimed is:

1. A biodegradable coating composition for coating fibers, comprising biodegradable mineral oil having a viscosity of 2.5 to 100 mPa•s (20° C.), a density of 790 to 880 kg/m$^3$ (15° C.), and a viscosity/density constant (VDC) of 0.770 to 0.810.

2. A coating composition according to claim 1, wherein, in addition to the mineral oil, the coating composition contains up to 15 wt. % of a metal salt of a saturated or unsaturated fatty acid as a lubricant.

3. A coating composition according to claim 2, wherein the lubricant is an Li, Na, K, Al, Mg, Ca or Zn salt of a higher fatty acid.

4. A coating composition according to claim 3, wherein the lubricant is selected from the group consisting of Al stearate, Ca stearate, Li stearate, Mg stearate, Zn stearate, Mg palmitate and Mg oleate.

5. A coating composition according to claim 1, wherein the coating composition further comprises up to 15 wt. % of an anti-static agent.

6. A coating composition according to claim 5, wherein the anti-static agent is a cationic, anionic or nonionic anti-static agent.

7. A coating composition according to claim 6, wherein the anti-static agent is a cationic anti-static agent selected from the group consisting of ammonium compounds, an anionic anti-static agent selected from the group consisting of sulfonic acid salts and phosphoric acid salts, or a nonionic anti-static agent selected from the group consisting of fatty acid esters, phosphoric acid esters, and alkoxylated polydimethylsiloxanes.

8. A coating composition according to claim 6, wherein the anti-static agent is a dialkylsulfosuccinate of the general formula (a)

(1)

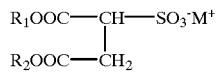

, in which $R_1$ and $R_2$ are the same or different and each represents hydrogen or an alkyl group having 1 to 30 carbon atoms and $M^+$ is $H^+$, $Li^+$, $NA^+$, $K^+$ or $NH_4^+$.

9. A coating composition according to claim 8, characterised in that the dialkylsulfosuccinate is selected from the group comprising sodium diisobutylsulfosuccinate, sodium dioctylsulfosuccinate, sodium dihexylsulfosuccinate, sodium diamylsulfosuccinate and sodium dicyclohexylsulfosuccinate.

10. A process for dressing fibers, filaments or yarns, which comprises applying the coating composition according to claim 1 onto the surface of said fibers, filaments or yarns, wherein the coating composition is applied in a quantity of 0.5 to 15 wt. % relative to the weight of the fibers.

11. A method for coating mouldings made from polymers, which comprises applying to said mouldings the composition of claim 1.

* * * * *